US010098400B2

(12) United States Patent
Johnson

(10) Patent No.: US 10,098,400 B2
(45) Date of Patent: Oct. 16, 2018

(54) ADJUSTABLE, CONFIGURABLE HAT

(71) Applicant: Deborah Jeanne Johnson, Villa Park, CA (US)

(72) Inventor: Deborah Jeanne Johnson, Villa Park, CA (US)

( * ) Notice: Subject to any disclaimer, the term of this patent is extended or adjusted under 35 U.S.C. 154(b) by 598 days.

(21) Appl. No.: 13/800,090

(22) Filed: Mar. 13, 2013

(65) Prior Publication Data

US 2014/0130235 A1 May 15, 2014

Related U.S. Application Data

(60) Provisional application No. 61/752,197, filed on Jan. 14, 2013, provisional application No. 61/726,183, filed on Nov. 14, 2012.

(51) Int. Cl.

| | |
|---|---|
| ***A42B 1/22*** | (2006.01) |
| ***A42B 1/24*** | (2006.01) |
| ***A42B 1/20*** | (2006.01) |

(52) U.S. Cl.

CPC ..... *A42B 1/225* (2013.01); *A42B 1/206* (2013.01); *A42B 1/241* (2013.01)

(58) Field of Classification Search

CPC ..... A42B 1/225; A42B 1/22

(Continued)

(56) References Cited

U.S. PATENT DOCUMENTS 2,066,713 A 1/1937 Bowland
4,999,852 A * 3/1991 Murray ..... A42B 1/201 2/171.7

(Continued)

FOREIGN PATENT DOCUMENTS

WO 1999066811 A1 12/1999

OTHER PUBLICATIONS

International Search Report and Written Opinion for PCT/US13/69561, dated May 14, 2014, 12 pages.

(Continued)

*Primary Examiner* — Katherine Moran
*Assistant Examiner* — Brieanna Szafran
(74) *Attorney, Agent, or Firm* — Fredrikson & Byron, P.A.

(57) ABSTRACT

An adjustable, configurable hat is described that can be configured to accommodate a variety of hairstyles. In general, the adjustable, configurable hat has a crown member, an enlarged opening and a panel that is releasably attachable to the crown member. In one example, the adjustable, configurable hat generally has an open configuration and a closed configuration. In the closed configuration, the panel is releasably attached to the crown member by the fastening mechanisms, covers the enlarged opening and generally has the appearance of a hat that is not adjustable and configurable. In the open configuration, the panel is releasably attached to the inside of the crown member by the fastening members such that it is not visible when the hat is worn and the enlarged opening allows the wearer of the hat to wear a variety of hairstyles while wearing the hat. In both configurations, the fastening mechanisms and the panel are hidden by the crown member. In another example, the crown is split down the back center to have a left and right half and the hat can be configured to its open configuration by separating the left half from the right half and folding each half inside two respective pockets inside the hat.

7 Claims, 19 Drawing Sheets

(58) Field of Classification Search
USPC ..... 2/209.11, 171.1, 171.7, 209.3, 209.12, 2/171.5, 171.4, 171.6
See application file for complete search history.

(56) References Cited

U.S. PATENT DOCUMENTS

| | | | | |
|---|---|---|---|---|
| 5,799,334 | A | 9/1998 | Griffith et al. | |
| 6,202,219 | B1 * | 3/2001 | Cheever | A42B 1/22 2/175.1 |
| 6,240,566 | B1 | 6/2001 | Scantlin | |
| 6,560,785 | B1 * | 5/2003 | Taguchi | A42B 1/206 2/10 |
| 7,062,793 | B2 | 6/2006 | Liao | |
| 7,962,971 | B1 * | 6/2011 | Spence | A42B 1/206 2/171.1 |
| D707,018 | S | 6/2014 | Hart et al. | |
| 2011/0041238 | A1 | 2/2011 | Brzoska | |

OTHER PUBLICATIONS

Ponytail Snap-Cap, [online] Retrieved from <http://www.ponytailsnapcap.com/> on Feb. 18, 2016, 1 page.
Ponytail Snap-Cap Products, [online] Retrieved from <http://www.ponytailsnapcap.com/products.html> on Feb. 18, 2016, 1 page.

* cited by examiner

ADJUSTABLE, CONFIGURABLE HAT

PRIORITY CLAIM

This application claims priority to U.S. Provisional Application No. 61/726,183 entitled "Adjustable, Configurable Hat" by Deborah Jeanne Johnson filed on Nov. 14, 2012 and U.S. Provisional Application No. 61/752,197 entitled "Adjustable, Configurable Hat" by Deborah Jeanne Johnson filed Jan. 14, 2013 both of which are incorporated herein in their entirety.

FIELD

This disclosure relates generally to headwear, particularly headwear able to accommodate a wide variety of hairstyles.

BACKGROUND

Hats are apparel designed to be worn on the head of individuals and are manufactured in a multitude of methods and a variety of designs. Hats are often worn for functional purposes including, for example, keeping an individual's head warm or the sun out of an individual's eyes. Hats are also worn for aesthetic purposes that are often independent from the functionality of the hat. For example, an individual may wear a winter hat because it is embroidered with a logo of the individual's favorite sports team, or an individual may wear a hat with a particular design as an accessory to the individual's chosen outfit.

Individuals having short hair are generally able to freely enjoy the functionality and aesthetic appeal of hats. Individuals with longer hair, however, are generally more limited in the types of hats they can wear as the hat must be able to accommodate the individual's long hair. Furthermore, hats able to accommodate long hair are generally only able to accommodate the hair in a limited number of ways.

For example, one common hat that is able to accommodate individuals with long hair is the adjustable baseball cap. Adjustable baseball caps generally have an opening in the rear of the cap that can be used to allow an accumulation of hair to pass through. Individuals with long hair who wish to wear an adjustable baseball cap will typically tie their hair in a low ponytail, a ponytail located near the base of an individual's head, and thread the low ponytail through the opening in the rear of the cap. The low ponytail is generally the only hairstyle such an adjustable baseball cap can accommodate.

The adjustable baseball cap examples the tradeoff encountered by individuals with long hair who wish to wear a hat: wearing a specific hat may limit the type of hairstyles an individual can wear, and wearing a specific hairstyle may limit the type of hats an individual can don.

SUMMARY

In some embodiments, an adjustable, configurable hat which includes a headband shaped to fit about the circumference of an individual's head; a crown member with at least one opening to allow an accumulation of hair to pass through; at least one panel that is configured to at least partially cover the at least one opening; at least one tether fixably attaching the at least one panel to the crown member; and a fastening system which includes at least a first and second fastening mechanism to releasably attach the panel to the crown member in at least two configurations, the fastening system being visibly hidden by the crown member. In the first configuration, the at least one panel is releasably attached to the crown member to cover the at least one opening. In the second configuration, the at least one panel is releasably attached to the crown member in such a way that the opening is left exposed and the panel is visibly hidden by the crown member.

In some embodiments, an adjustable, configurable hat which includes a headband shaped to fit about the circumference of an individual's head; a crown member with at least one opening to allow an accumulation of hair to pass through; at least one flap configured to at least partially cover the at least one opening; and a fastening system which includes at least a first and second fastening mechanism to releasably attach the flap to the crown member in at least two configurations, the fastening system being visibly hidden by the crown member. In the first configuration, the at least one flap is releasably attached to the crown member to cover the at least one opening. In the second configuration, the at least one flap is releasably attached to the crown member in such a way that the opening is left exposed and the flap is visibly hidden by the crown member.

In some embodiments, an adjustable, configurable hat which includes an adjustable headband shaped to fit about the circumference of an individual's head; a crown member with at least one opening to allow an accumulation of hair to pass through; at least one panel configured to at least partially cover the at least one opening; at least one tether fixably attaching the at least one panel to the crown member; and a fastening system which includes at least a first and second fastening mechanism to releasably attach the panel to the crown member in a plurality of configurations, the fastening mechanism being visibly hidden by the crown member. The collective circumference having the purpose of varying the collective circumference of the crown member and the panel.

In some embodiments, an adjustable, configurable hat which includes a headband shaped to fit about the circumference of an individual's head; a crown member with at least one opening to allow an accumulation of hair to pass through, the opening exposing at least about 30% of an individual's head; at least one panel configured to at least partially cover the at least one opening; and at least one tether fixably attaching the at least one panel to the crown member. The hat can be configured in an open and closed configuration. In the open configuration the panel does not cover the opening in the crown member thereby leaving the opening exposed. In the closed configuration, the panel covers the opening in the crown member.

BRIEF DESCRIPTION OF THE DRAWINGS

The following drawings illustrate some particular embodiments of the present invention and therefore do not limit the scope of the invention. The drawings are not to scale (unless so stated) and are intended for use in conjunction with the explanations in the following detailed description. Some embodiments will hereinafter be described in conjunction with the appended drawings, wherein like numerals denote like elements.

DETAILED DESCRIPTION OF THE PREFERRED EMBODIMENTS

The following detailed description is exemplary in nature and is not intended to limit the scope, applicability, or configuration of the invention in any way. Rather, the following description provides some practical illustrations for implementing some embodiments of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

Figure 1:
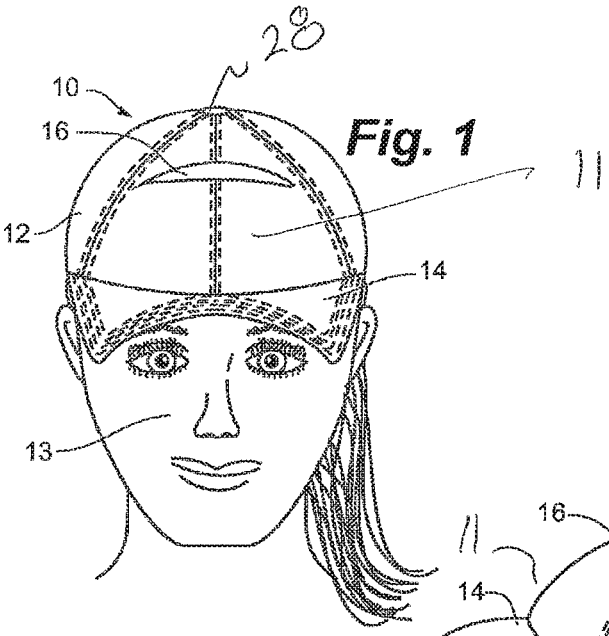
FIG. 1 is a front perspective view of an adjustable, configurable hat in accordance with an embodiment.

FIG. 1 is a front perspective view of an adjustable, configurable hat 10 in accordance with an embodiment. FIG. 1 illustrates crown member 12 which is configured to fit on a an individual's head 13; bill 14 which is attached to crown member 12; and front design 16 which is located on crown member 12. The adjustable, configurable hat 10 is configured in the style of a baseball cap and, as shown in FIG. 1, the front of the hat has the appearance of a traditional baseball cap.

In this example, crown member 12 is dome shaped and substantially covers an individual's head 13. It can be appreciated that in different examples, crown member 12 can vary in shape and size and can cover more or less of an individual's head 13. Crown member 12 can also be made from a variety of materials in a variety of colors.

Bill 14 is attached to, and centered on, the front 11 of crown member 12 and extends angularly forward from crown member 12. When the front 11 of crown member 12 is aligned with the front of an individual's head 13, bill 14 extends above the individual's eyes. The front 11 extends from the top in a forward direction that covers the front portion of a wearer's head. The crown member 12 has a back portion extending from the top in a backward direction. Adjustable, configurable hat 10 need not be worn in such a way that the front 11 of crown member 12 aligns with the front of an individual's head 13. While FIG. 1 shows an adjustable, configurable hat 10 which includes bill 14, it can be appreciated that other examples may not include bill 14.

FIG. 1 also illustrates design 16 which is located on exterior surface that faces the environment when the hat is worn by a wearer, the front 11 of crown member 12. Design 16 is centered on the front 11 of crown member 12 and comprises an embroidered logo of a sports team. It can be appreciated that in other examples design 16 may have any variety of designs and be formed from any type of material. The location of the design 16 need not be limited to the front 11 center of the crown member 12, but may be located on a side of the crown member 12 or the back 17 of the crown member 12. In addition, in some examples there is no design.

Figure 2:
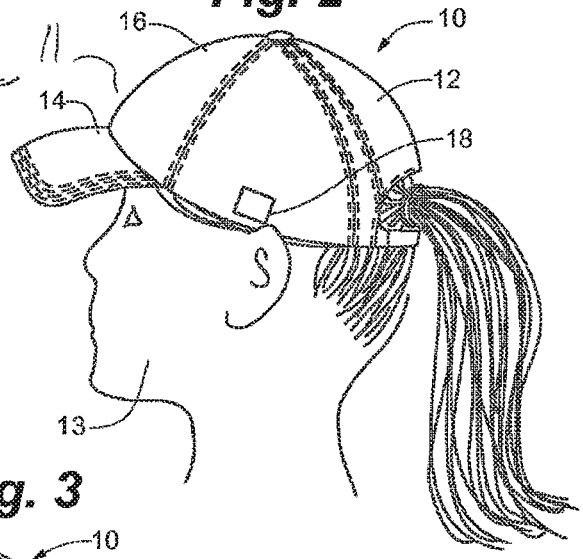
FIG. 2 is a side perspective view of an adjustable, configurable hat in a closed configuration in accordance with an embodiment.

FIG. 2 is a side perspective view of an adjustable, configurable hat 10 in a closed configuration in accordance with an embodiment. As in FIG. 1, FIG. 2 illustrates crown member 12 configured to fit on an individual's head 13; bill 14 attached to crown member 12; design 16 found on crown member 12; and additionally design 18 which is found on a side of crown member 12. In this example, design 18 is an embroidered logo of the manufacturer of the hat. It can be appreciated that in other examples, design 18 may vary in number and be configured in any variety of designs and be formed from any type of material. The location of design 18 need not be limited to a side of crown member 12. Other examples may not include design 18.

Figure 3:
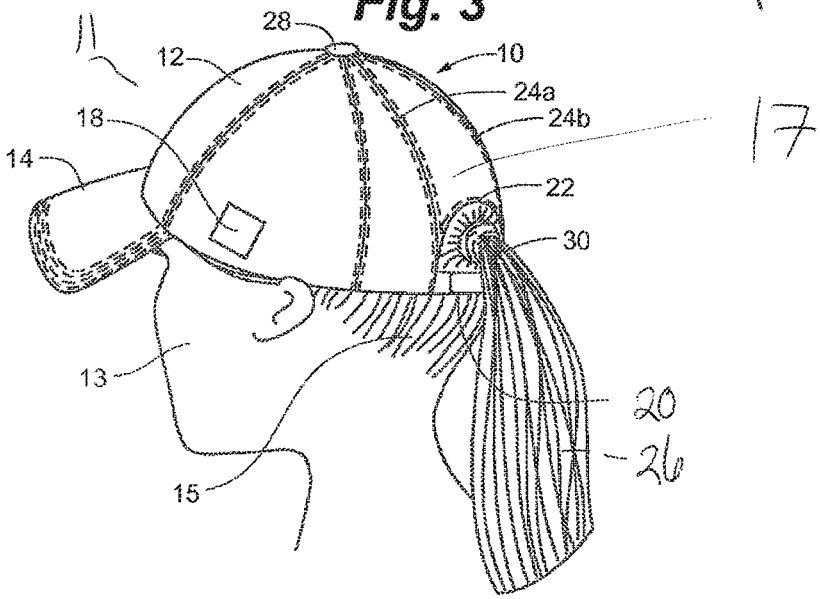
FIG. 3 is a rear perspective view of an adjustable, configurable hat in a closed configuration in accordance with an embodiment.

FIG. 3 is a rear perspective view of an adjustable, configurable hat 10 in a closed configuration in accordance with an embodiment. FIG. 3 illustrates panel 22 fastened to crown member 12; opening 30 through which a low ponytail 26 passes through; and headband 20. In this example, panel 22 can be releasably attached to crown member 12 by fastening mechanisms (not shown) in two different configurations: an open configuration and a closed configuration. FIG. 3 shows the adjustable, configurable hat 10 in a closed configuration where panel 22 is releasably attached to crown member 12 such that panel 22 substantially covers enlarged opening 32 (see FIG. 4). In this closed configuration, adjustable, configurable hat 10 has the appearance of a traditional baseball cap from the rear.

FIG. 3 shows panel 22 located near the rear of crown member 12 and is substantially wedge shaped. Panel 22 begins at top 28 of crown member 12 and extends toward headband 20 situated near base 15 of crown member 12. The shape and size of panel 22 is not limited to wedge shaped and can be designed and manufactured to be any suitable size or shape. In this example, panel 22 is made of the same material as crown member 12 to provide adjustable, configurable hat 10 a substantially uniform appearance. FIG. 3 shows seams 24*a*, 24*b*, the seams showing the boundary between crown member 12 and panel 22. In other examples, panel 22 and crown member 12 may be designed and manufactured in such a way that the seams 24*a*, 24*b* are disguised or hidden.

FIG. 3 also shows headband 20 located near base 15 of the crown member 12. In this example, headband 20 is adjustable and can be configured to change the circumference of the crown member 12 to provide a better fit around an individual's head 13 when the hat is worn by the wearer. Headband 20 comprises two straps releasably secured together by a hook-and-loop type fastener such as that commercially sold under the brand Velcro™ for example. The straps can be released from each other and realigned to increase or decrease the circumference of the headband 20. In other examples, the two straps comprising headband 20 may be releasably secured by adjustable snapback or any other suitable adjusting mechanism. Headband 20 may also be configured to be non-adjustable; comprising only a single strip of material, and crown member 12 and panel 22 may be designed to give adjustable, configurable hat 10 in appearance of a fitted baseball cap.

When adjustable, configurable hat 10 is in a closed configuration, panel 22, crown member 12 and headband 20 form opening 30. While it can be appreciated that panel 22 can be sized and shape to increase, decrease or reshape opening 30, the style of adjustable, configurable hat 10 is that of a traditional baseball cap, and so panel 22, crown member 12 and headband 20 are configured to form opening 30 with dimensions consistent with the opening in a traditional baseball cap. FIG. 3 further shows low ponytail 26, a hairstyle commonly worn by individuals donning a traditional baseball cap, extending through opening 30.

Figure 4:
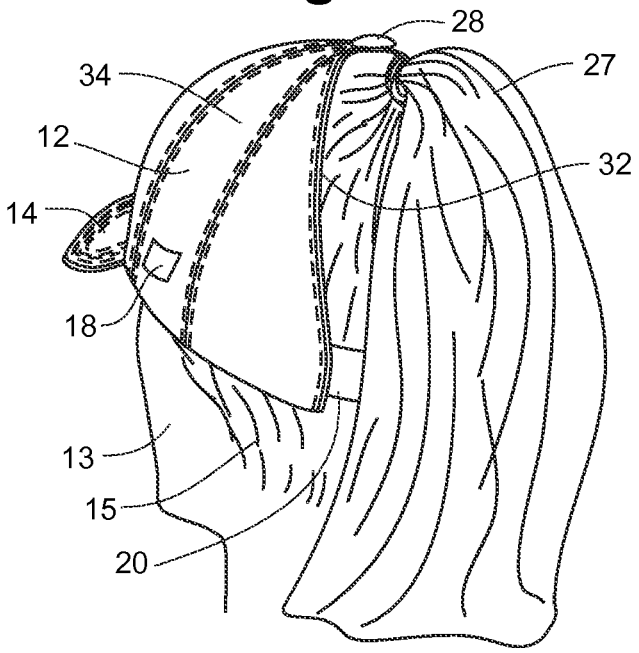
FIG. 4 is a rear perspective view of the adjustable, configurable hat shown in FIGS. 1-3 in an open configuration in accordance with an embodiment.

FIG. 4 is a rear perspective view of the adjustable, configurable hat 10 shown in FIGS. 1-3 in an open configuration in accordance with an embodiment. FIG. 4 shows enlarged opening 32 in crown member 12 where panel 22 was previously when adjustable, configurable hat 10 was in a closed configuration. Panel 22 (not shown) is releasably attached to interior surface 36 (not shown) of crown member 12 and is not visible from exterior surface 34 of crown member 12 when the hat is in this open configuration.

Enlarged opening 32 begins at top 28 of crown member 12 and extends toward headband 20 near the base 15 of crown member 12. As with panel 22, the shape and size of enlarged opening 32 can be designed and manufactured to be any suitable shape or size. So in another example, enlarged opening 32 may extend vertically from the base 15 of crown member 12 toward the top 28 of crown member 12 and extend horizontally for one eighth to one half of the circumference of the crown member 12. Generally, enlarged opening 32 should be sized to expose at least about 20% of an individual's head 13 to allow an accumulation of hair to pass through. As shown in FIG. 4, enlarged opening 32 allows individuals wearing adjustable, configurable hat 10 to wear a wider variety of hairstyles, like a high ponytail 27. As can be appreciated, an individual wearing a traditional baseball cap with an opening similar to opening 30, as shown in FIG. 3, would not be able to wear a high ponytail 27 because the position of high ponytail 27 on an individual's head 13 would not align with the opening of the traditional baseball cap. Other more elaborate hairstyles that cannot be worn with a traditional baseball cap, but can be worn with adjustable, configurable hat 10 in an open configuration will be further illustrated.

Figure 5:
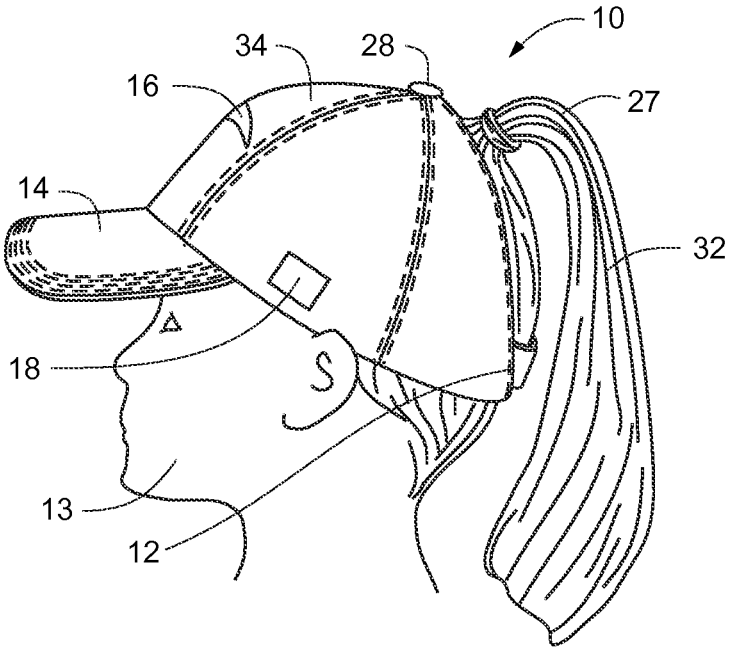
FIG. 5 is a side perspective view of an adjustable, configurable hat in an open configuration in accordance with an embodiment.

FIG. 5 is a side perspective view of the adjustable, configurable hat 10 shown in FIG. 4 in an open configuration in accordance with an embodiment. Adjustable, configurable hat 10 in an open configuration still appears substantially similar to a traditional baseball cap. As noted above, panel 22 (not shown) has been fastened to an interior surface 36 (not shown) of crown member 12 and is not visible from exterior surface 34. Likewise, all fastening mechanisms releasably attaching panel 22 to crown member 12 are also not visible from exterior surface 34. Both design 18 and design 16 remain clearly visible. While a front perspective view of adjustable, configurable hat 10 in an open configuration is not provided, it can be appreciated that the front of adjustable, configurable hat 10 will continue to have the appearance, and silhouette of a traditional baseball cap.

FIG. 6 through FIG. 9 show an adjustable, configurable hat 40 being transitioned from a closed configuration to an open configuration.

Figure 6:
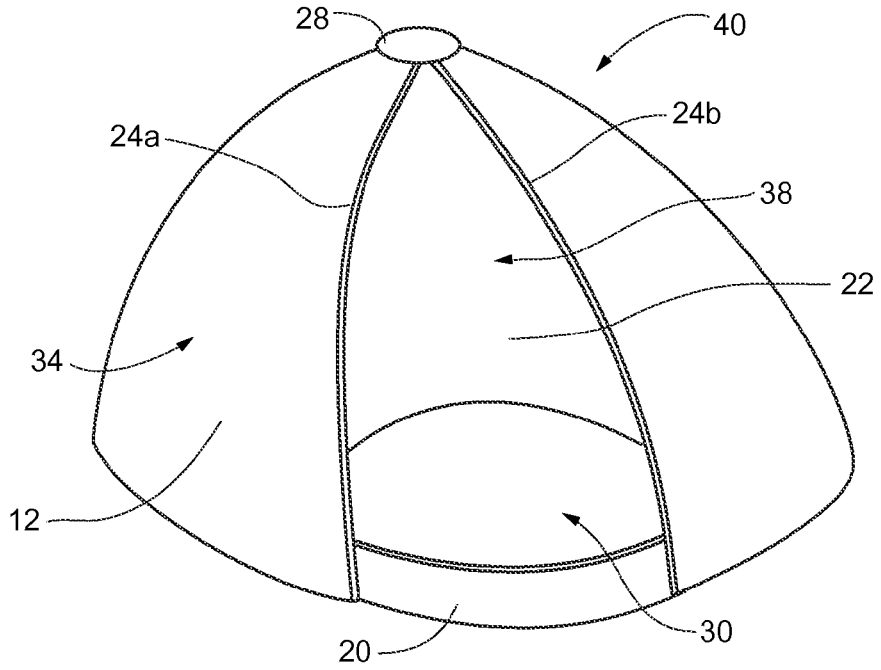
FIG. 6 is a rear view of an adjustable, configurable hat in a closed configuration in accordance with an embodiment.

FIG. 6 is a rear view of an adjustable, configurable hat 40 in a closed configuration in accordance with an embodiment. FIG. 6 shows crown member 12 with exterior surface 34, panel 22 with exterior surface 38, headband 20, and opening 30. A tether 44 (see FIG. 7) permanently attaches the panel 22 to the crown member 12. Panel 22 is releasably attached to portions of the crown member 12 by fastening mechanisms 40*a*, 40*b* (not shown) fixed on exterior surface 38 of panel 22, and fastening mechanisms 41*a*, 41*b* (not shown) fixed on the interior surface 36 of crown member 12. As shown in FIG. 6, adjustable, configurable hat 40 in a closed configuration has the appearance of a traditional baseball cap from the rear.

Figure 7:
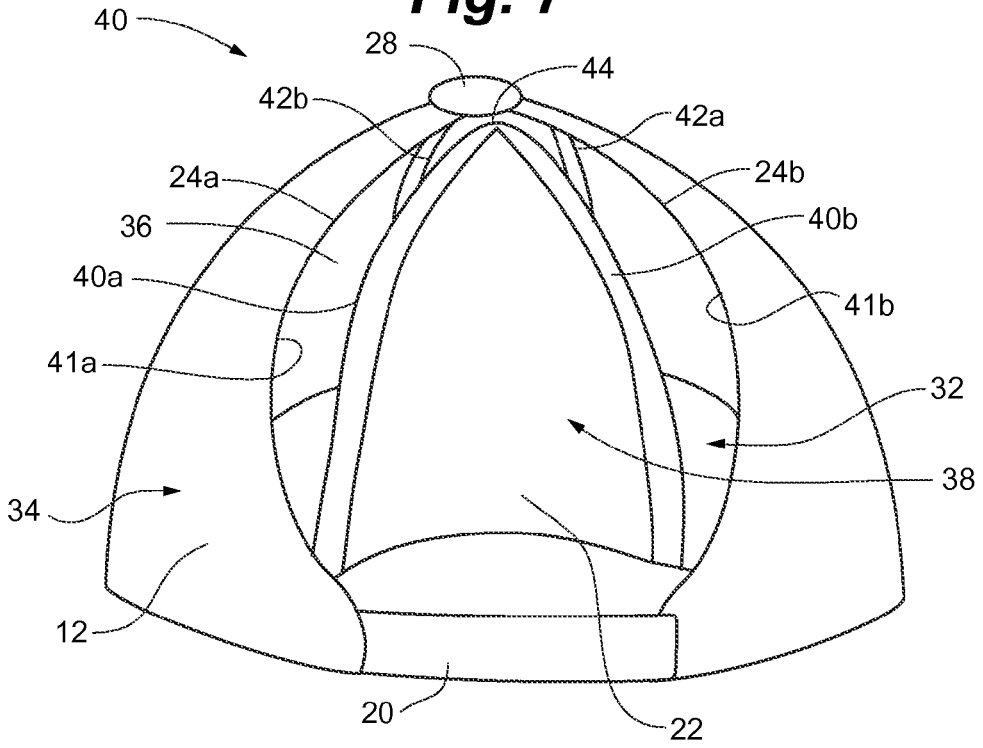
FIG. 7 is a rear view of the adjustable, configurable hat in FIG. 6 being transitioned from a closed configuration to an open configuration.

FIG. 7 is a rear view of the adjustable, configurable hat 40 in FIG. 6 being transitioned from a closed configuration to an open configuration. FIG. 7 shows panel 22 unfastened from portions of the crown member 12; tether 44 fixably attaching panel 22 to crown member 12; enlarged opening 32; fastening mechanisms 40*a*, 40*b* fixed to the exterior surface 38 of panel 22; and fastening mechanisms 42*a*, 42*b* fixed to the front interior surface 36 of crown member 12. Fastening mechanisms 41*a*, 41*b* (not visible) are fixed to the interior surface 36 of crown member 12 generally along seams 24*a*, 24*b*, respectively.

In this example, fastening mechanisms 40*a*, 40*b*, 41*a*, 41*b*, 42*a*, 42*b* comprise a fastening system configured to releasably attach panel 22 to portions of the crown member 12 in either an open or closed configuration. In one example, the fastening system is a hook-and-loop type fastener. Fastening mechanisms 40*a*, 40*b* preferably are hook fasteners, while fastening mechanisms 41*a*, 41*b*, 42*a*, 42*b* are loop fasteners. When fastening mechanisms 40*a*, 40*b* are fastened to fastening mechanisms 41*a*, 41*b*, adjustable, configurable hat 40 is in a closed configuration. Alternatively, when fastening mechanisms 40*a*, 40*b* are fastened to fastening mechanisms 42*a*, 42*b*, adjustable, configurable hat 40 is in an open configuration. While FIG. 7 shows hook-and-loop based fastening mechanisms, other fastening mechanisms may be used such as zippers, snaps or magnets, or a combination of different fastening mechanisms. Furthermore, as shown in FIG. 7, the fastening mechanisms are located in positions that are not visible from the exterior of the crown member and will therefore not draw attention away from or obstruct designs 16, 18 (shown in FIGS. 1-5).

FIG. 7 shows fastening mechanism 40*a*, 40*b* unfastened from fastening mechanism 41*a*, 41*b*, respectively. Consequently, panel 22 is not flush with exterior surface 34 of crown member 12 and enlarged opening 32 is formed from the area where panel 22 and opening 30 (not shown) once were. While panel 22 has been unfastened from crown member 12, panel 22 is still fixably attached to crown member 12 by tether 44. Tether 44 is generally formed from a short piece of material having at least a first end and a second end. In this example, the first end (not visible) of tether 44 is fixed to top 28 of crown member 12 and the second end (not visible) of tether 44 is fixed to a top of the panel 22. Tether 44 fixably attaches panel 22 to crown member 12 so that panel 22 will remain with adjustable, configurable hat 10 when panel 22 is unfastened from crown member 12. In another example, tether 44 may releasably attach the panel 22 to crown member 12, the tether 44 may be fixably attached to crown member 12 and detachable from panel 22, or vice versa.

Figure 8:
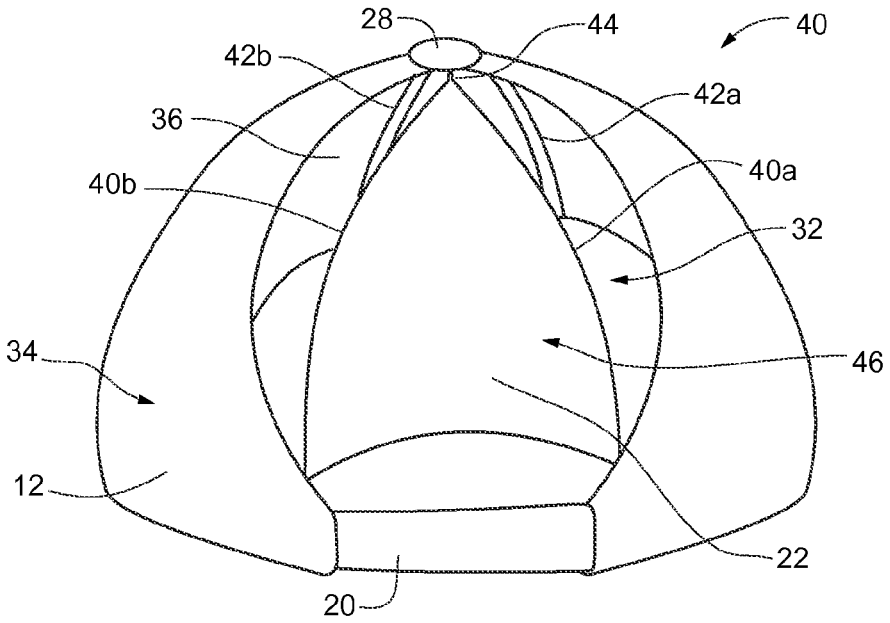
FIG. 8 is a rear view of the adjustable, configurable hat in FIG. 6 still being transitioned from a closed configuration to an open configuration.

FIG. 8 is a rear view of the adjustable, configurable hat 40 in FIG. 6 still being transitioned from a closed configuration to an open configuration. In FIG. 8, panel 22 is still unfastened from crown member 12, but has been rotated 180 degrees about tether 44 such that interior surface 46 of panel 22 is facing outward and exterior surface 38 (not shown), on which are located fastening mechanisms 40*a*, 40*b*, of panel 22 is facing inward. When panel 22 is in this orientation, fastening mechanisms 40*a*, 40*b* (not visible) on panel 22 are aligned with fastening mechanisms 42*a*, 42*b*, respectively, on the front interior surface 36 of crown member 12.

Figure 9:
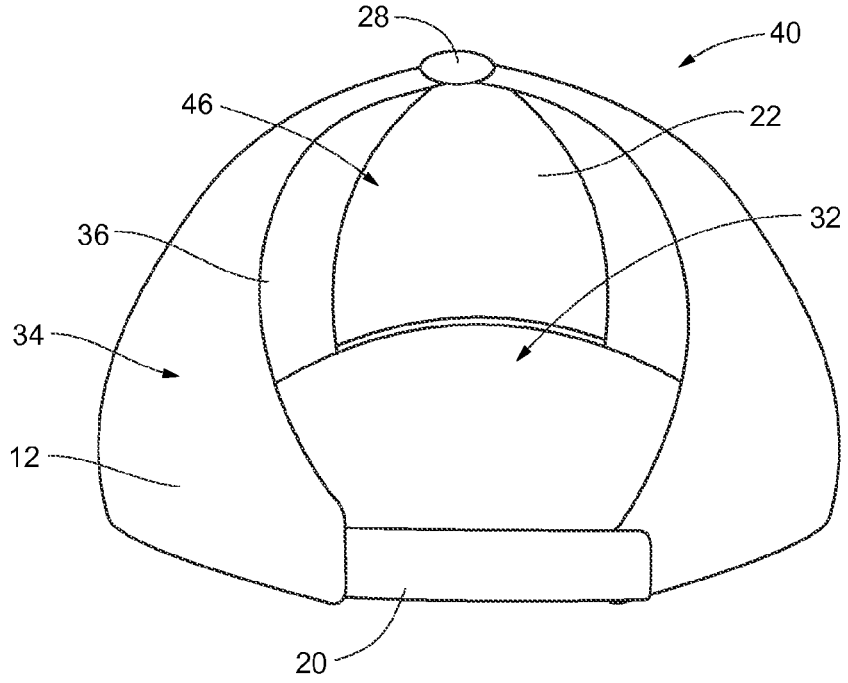
FIG. 9 is a rear view of the adjustable, configurable hat in FIG. 6 in an open configuration.

FIG. 9 is a rear view of the adjustable, configurable hat 40 in FIG. 6 in an open configuration. FIG. 9 illustrates panel 22 releasably attached to the interior surface 36 of crown member 12. After the panel 22 has been unfastened from the crown member 12, the panel is twisted 180 degrees about the tether so that fastening mechanism 40*a*, 40*b* on the panel 22 face the fastening mechanism 42*a*, 42*b* on the interior of the crown member 12. Fastening mechanism 40*a*, 40*b* (not shown) on panel 22 are secured to fastening mechanisms 42*a*, 42*b* (not shown), respectively, on the front interior surface 36 of crown member 12. In this orientation, interior surface 46 of panel 22 is facing inward and exterior surface 38 of panel 22 (not shown) is adjacent to the interior surface 36 of crown member 12 facing outward. As illustrated in FIG. 9, the panel is located in a position such that it is not visible from the exterior of the crown member and therefore will not draw attention away from or obstruct designs 16, 18 (shown in FIGS. 1-5). Thus, the transition from a closed configuration, as illustrated in FIG. 6, to an open configuration is complete. In this open configuration, enlarged opening 32 is fully exposed allowing an individual wearing adjustable, configurable hat 40 to wear a wide variety of hairstyles.

FIG. 10 through FIG. 15 show a variety of hairstyles that can be worn with adjustable, configurable hat 10 that cannot typically be worn with a traditional baseball cap with an opening similar to opening 30 as shown in FIG. 3.

Figure 10:
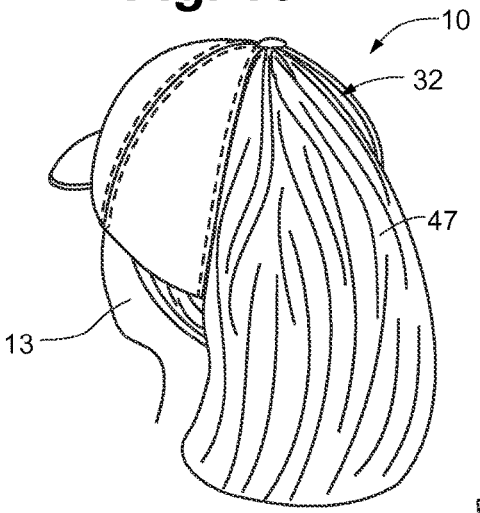
FIG. 10 is a rear perspective view of an adjustable, configurable hat in an open configuration in accordance with an embodiment.
Figure 11:
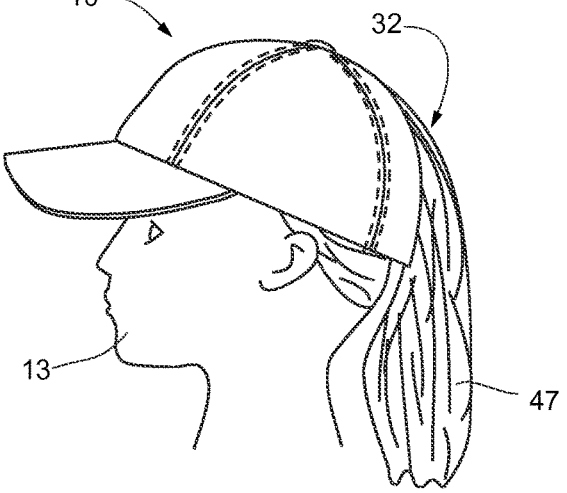
FIG. 11 is a side perspective view of the adjustable, configurable hat in FIG. 10 in an open configuration.
Figure 12:
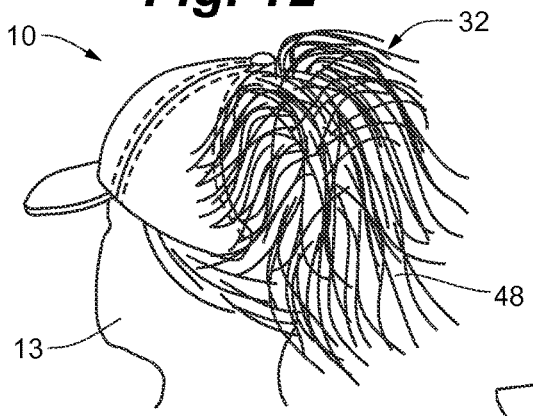
FIG. 12 is a rear perspective view of an adjustable, configurable hat in an open configuration in accordance with an embodiment.
Figure 13:
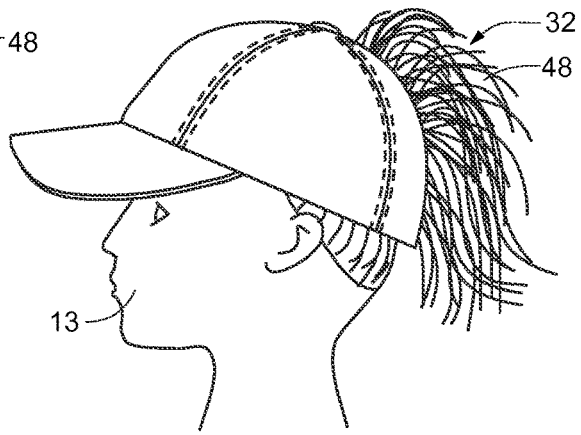
FIG. 13 is a side perspective view of the adjustable, configurable hat in FIG. 12 in an open configuration.
Figure 14:
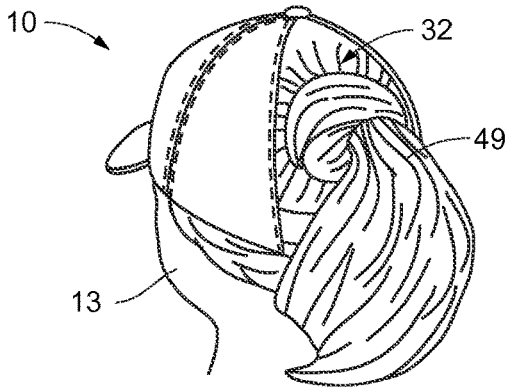
FIG. 14 is a rear perspective view of an adjustable, configurable hat in an open configuration in accordance with an embodiment.
Figure 15:
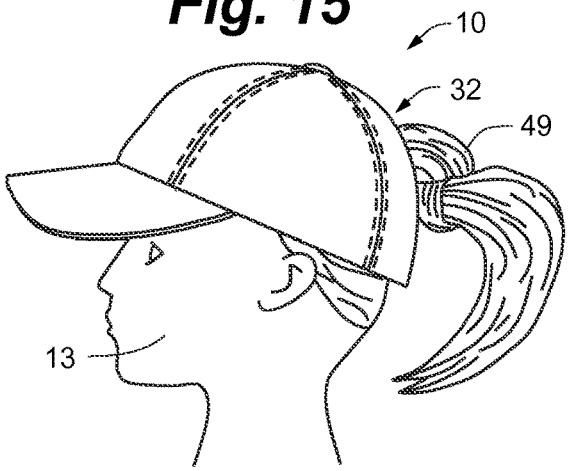
FIG. 15 is a side perspective view of the adjustable, configurable hat in FIG. 14 in an open configuration.

FIG. 10 is a rear perspective view of an adjustable, configurable hat 10 in an open configuration in accordance with an embodiment; and FIG. 11 is a side perspective view of the adjustable, configurable hat 10 in FIG. 10 in an open configuration. FIGS. 10 and 11 show straight hair 47 extending through enlarged opening 32. FIG. 12 is a rear perspective view of an adjustable, configurable hat 10 in an open configuration in accordance with an embodiment; and FIG. 13 is a side perspective view of the adjustable, configurable hat 10 in FIG. 12 in an open configuration. FIGS. 12 and 13 show messy updo 48 extending through enlarged opening 32. FIG. 14 is a rear perspective view of an adjustable, configurable hat 10 in an open configuration in accordance with an embodiment; and FIG. 15 is a side perspective view of the adjustable, configurable hat 10 in FIG. 14 in an open configuration. FIGS. 14 and 15 show messy bun 49 extending through enlarged opening 32.

Figure 16:
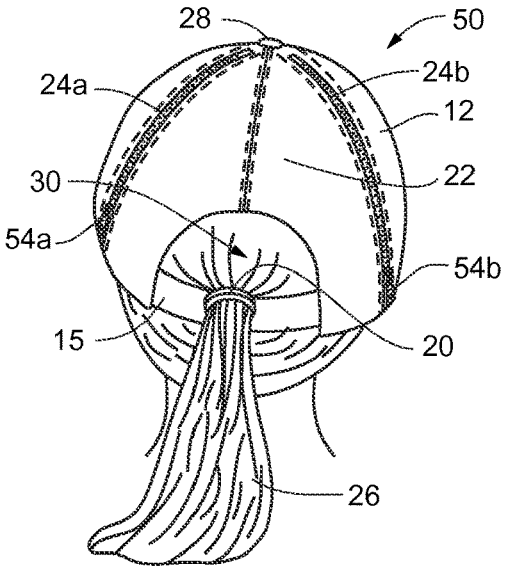
FIG. 16 is a rear perspective view of an adjustable, configurable hat in a closed configuration in accordance with an embodiment.

FIG. 16 is a rear perspective view of an adjustable, configurable hat in a closed configuration in accordance with an embodiment. FIG. 16 illustrates zipper 54*a*, 54*b* positioned along seams 24*a*, 24*b* and fastening panel 22 to crown member 12. As in previous figures, panel 22 starts near top 28 of crown member 12 and extends toward headband 20 near the base 15 of crown member 12. In this example, zippers 54*a*, 54*b* replace the hook-and-loop fastening mechanisms seen in previous examples. In addition to fastening panel 22 to crown member 12, zippers 54*a*, 54*b* also serve an aesthetic function in that they are colored to match front design 16 (not shown). In this embodiment, the bottom of panel 22 has loops (not shown) sewn in to allow the adjustable straps 20 to slide through before straps 20 are attached to each other for size and adjustment.

In another example, an adjustable, configurable hat with an adjustable headband may have fastening mechanisms to secure a panel in a plurality of positions relative to a crown member to increase the aesthetic appeal of the hat. In traditional baseball caps with adjustable headbands, when the headband is adjusted the shape of the cap's crown member is often distorted as the rear of the cap tends to bulge outward. Consequently, an adjustable, configurable hat configured to have the style of a traditional baseball cap in a closed position will have the same tendency to get distorted. For example, using FIG. 3 as a reference, when headband 20 is adjusted to decrease the circumference of headband 20, it will cause panel 22 to bulge outward because the collective circumference of crown member 12 and panel 22 will no longer be proportional to the circumference of adjusted headband 20. This distortion can be compensated for by fastening panel 22 relative to crown member 12 in such a way that releasably fixing the extra material causing panel 22 to bulge adjacent to the interior surface of crown member 12. Using FIG. 7 as a reference, fastening mechanisms 41*a*, 41*b* (not visible) may comprise wide strips of hook or loop running generally along seams 24*a*, 24*b*. Thus fastening mechanisms 41*a*, 41*b* need not fasten to crown member 12 only along seams 24*a*, 24*b*, but can rather be fastened further inward causing panel 22 and crown member 12 to overlap generally along seams 24*a*, 24*b*. This overlapping of material serves to reduce the collective circumference of crown member 12 and panel 22 to be proportional to the circumference of headband 20 when it is adjusted to be smaller.

Similarly, a panel of an adjustable, configurable hat can be configured such that the collective circumference of a crown member and the panel may be adjusted to be proportional to the circumference of a headband when the headband is adjusted to be larger. For example, again using FIG. 7 as a reference, panel 22 can configured to be wider than enlarged opening 32 such that when headband 20 is not adjusted, panel 22 and crown member 12 already overlap generally along seams 24*a*, 24*b*. When the circumference of headband 20 is increased, panel 22 can be adjusted relative to crown member 12 to let out material such that the collective circumference of crown member 12 and panel 22 is proportional to the circumference of headband 20 when it is adjusted to be larger.

Figure 17:
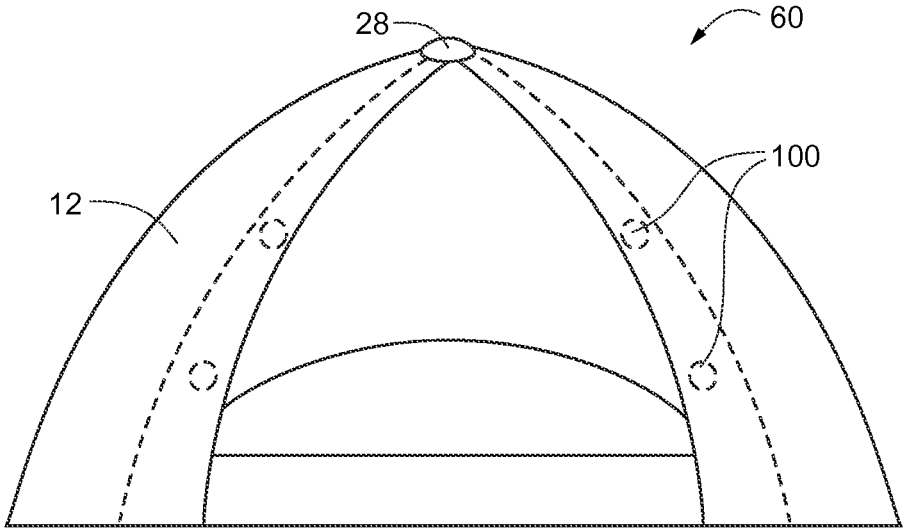
FIG. 17 is a rear perspective of an adjustable, configurable hat in an open configuration according to another embodiment of the invention.

It can be appreciated that while hook-and-loop fasteners have been illustrated, any type of fastening mechanisms may be used to either convert the hat from an open configuration to a closed configuration or adjust the collective circumference of a crown member and a panel. For example, again using FIG. 7 as a reference, instead of being hook-and-loop based, fastening mechanisms 40*a*, 40*b* and 41*a*, 41*b* may comprise a series of magnets 100 sewn into the fabric of panel 22 and crown member 12, respectively, such as shown in FIG. 17. The collective circumference of crown member 12 and panel 22 maybe adjusted by fixing additional magnets inward of seams 24*a*, 24*b*. These additional magnets allow panel 22 to be secured relative to crown member 12 in such a way that the material of each overlap generally along seams 24*a*, 24*b*. Unlike the hat that is converted to the open configuration, like the example shown in FIGS. 6-9, the panel need not be twisted but can be brought to the front of the crown member so that it lies adjacent to an interior front surface of the crown member 12. In addition, magnets may also be sewn into the interior front surface of the crown member 12 to hold it in place.

In yet another example, an adjustable, configurable hat may have a flap instead of a panel. Unlike a panel, which can substantially be completely unfastened from a crown member, the flap is attached to the crown member along one edge of the flap. Using FIG. 7 as a reference, the flap may have the same size and shape as panel 22 but is attached to crown member 12 along seam 24*a*. Consequently, in this example, there is no need for fastening mechanism 40*a* and 41*a*. Fastening mechanisms 40*b* and 41*b* are still necessary to hold the adjustable, configurable hat in a closed configuration. The flap would be configured to fold along seam 24*a* such that exterior surface 38 of the flap would face inward and the interior surface 46 of the flap (not shown) would be adjacent to interior surface 36 of crown member 12 facing outward. Additional fastening mechanisms may be fixed to interior surface 36 of crown member 12 and interior surface 46 of flap (not shown) to releasably attach the flap to the interior surface 36 of crown member 12. When the flap is releasably attached in this position, the adjustable, configurable hat 10 is in an open configuration.

Figure 18:
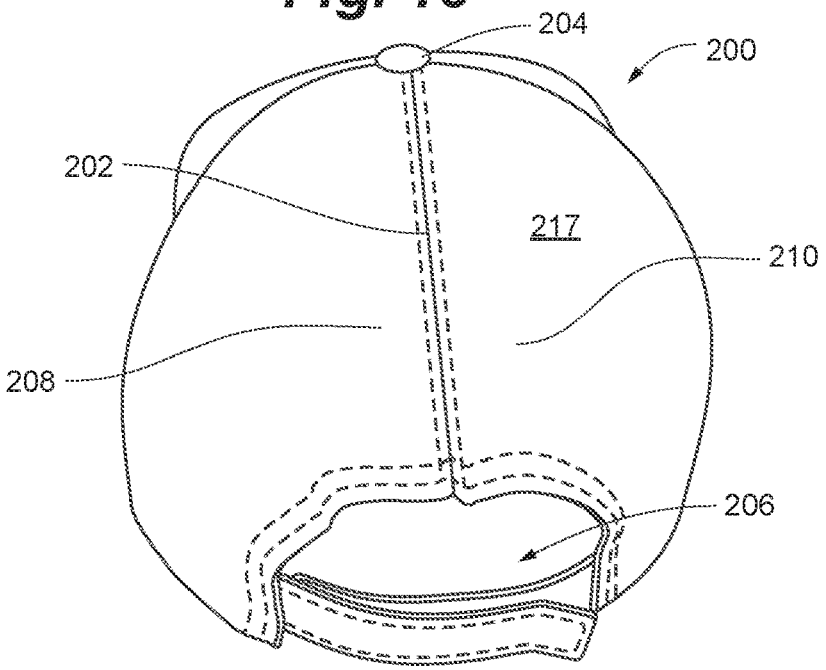
FIG. 18 is a rear perspective view of a configurable hat in a closed configuration according to another embodiment of the invention.

FIG. 18 is a rear perspective view of a configurable hat in a closed configuration according to another embodiment of the invention. In this particular embodiment, the hat 200 has a central seam 202 running from the top 204 of the hat 200 to the opening 206 in the back 217 of the hat 200. The seam 202 joins a left half 208 and a right half 210 of the back 217 of the hat together so that the hat is in a closed configuration.

Figure 19:
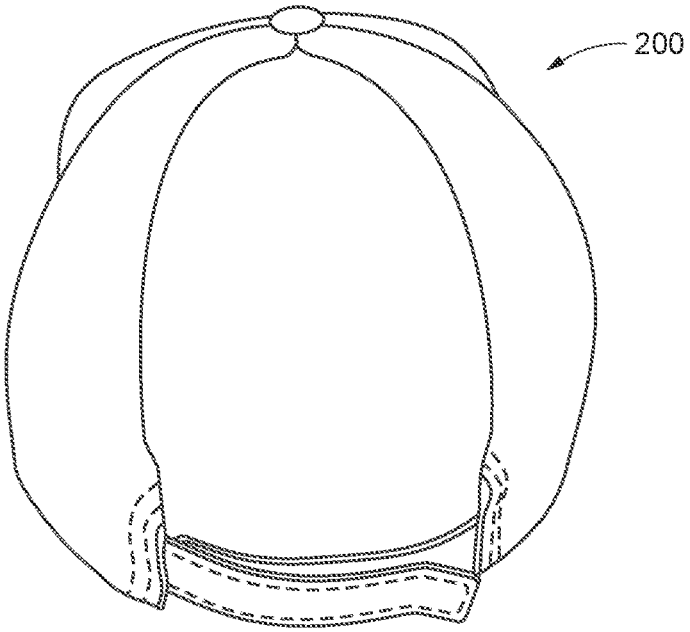
FIG. 19 is a rear perspective view of the configurable hat shown in FIG. 18 in an open configuration.

FIG. 19 is a rear perspective view of the configurable hat shown in FIG. 18 in an open configuration. As will be described in greater detail hereinafter, the left and right halves 208 and 210 have been folded back and secured inside the hat so that the hat is now in its open configuration to provide a large opening in the back 217 of the hat to accommodate various hairstyles.

Figure 20:
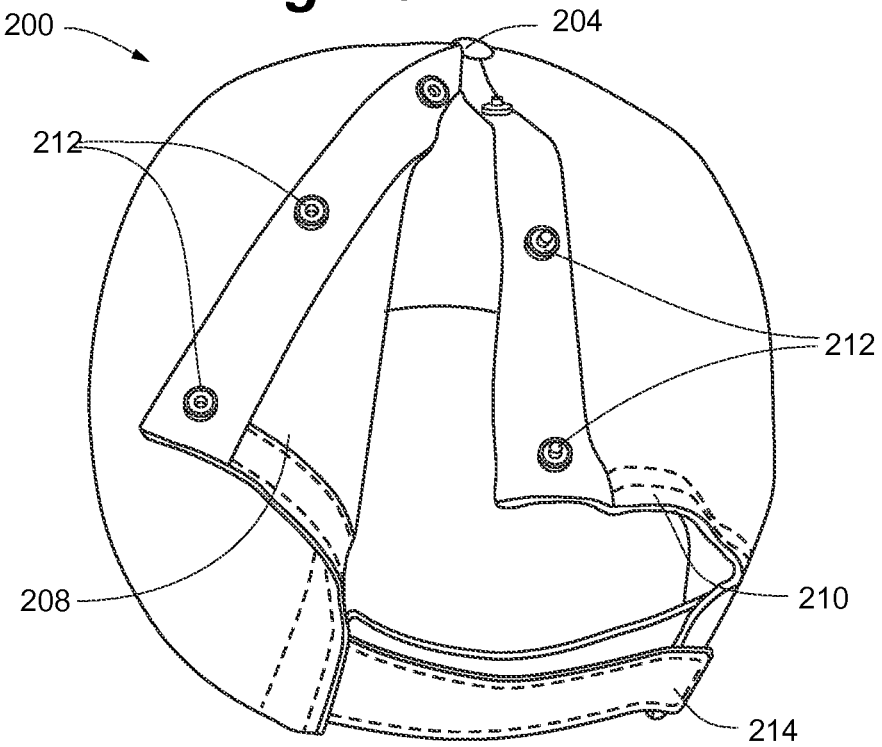
FIG. 20 is a rear perspective view of the configurable hat shown in FIGS. 18-19 being transitioned from a closed configuration to an open configuration.

FIG. 20 is a rear perspective view of the configurable hat shown in FIGS. 18-19 being transitioned from a closed configuration to an open configuration. The left and right halves 208, 210 are secured together at the central seam 202 by complementary fasteners 212 along each edge of the left and right halves that formed the central seam 202. In this particular embodiment, the fasteners are snap-type fasteners although as will be described hereinafter other types of fasteners may be used such as hook and loop fasteners, for example. As shown in FIG. 20, to transition the hat from a closed configuration to an open configuration, the fasteners are unfastened. Once all of the fasteners are unfastened, the left half 208 and the right half 210 are folded back inside the hat and are secured inside the hat as will be described.

Figure 21:
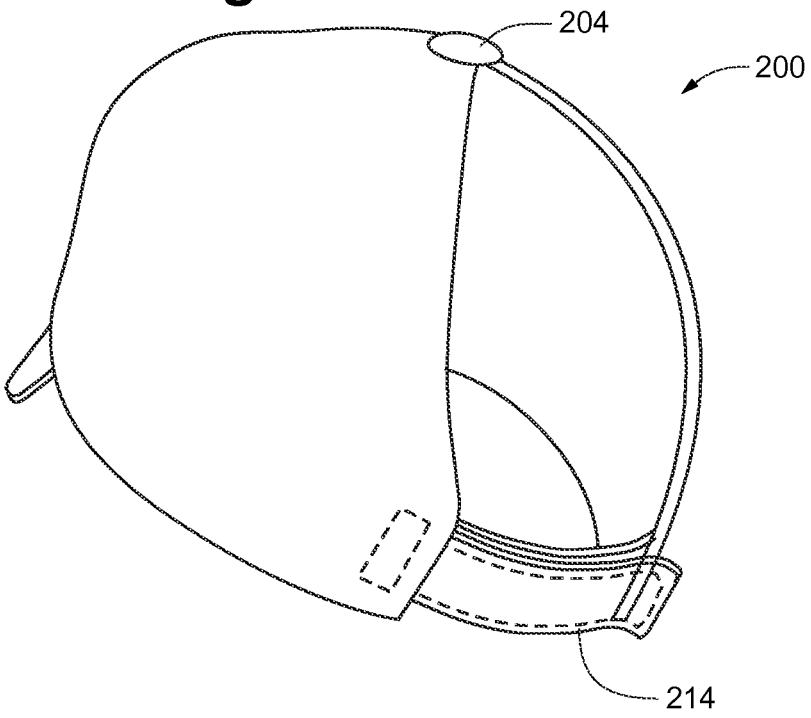
FIG. 21 is a side perspective view of the configurable hat shown in FIGS. 18-20.

FIG. 21 is a side perspective view of the configurable hat shown in FIGS. 18-20. It can be seen that the opening extends from the top of the hat, the crown, to the adjustable band 214.

Figure 22:
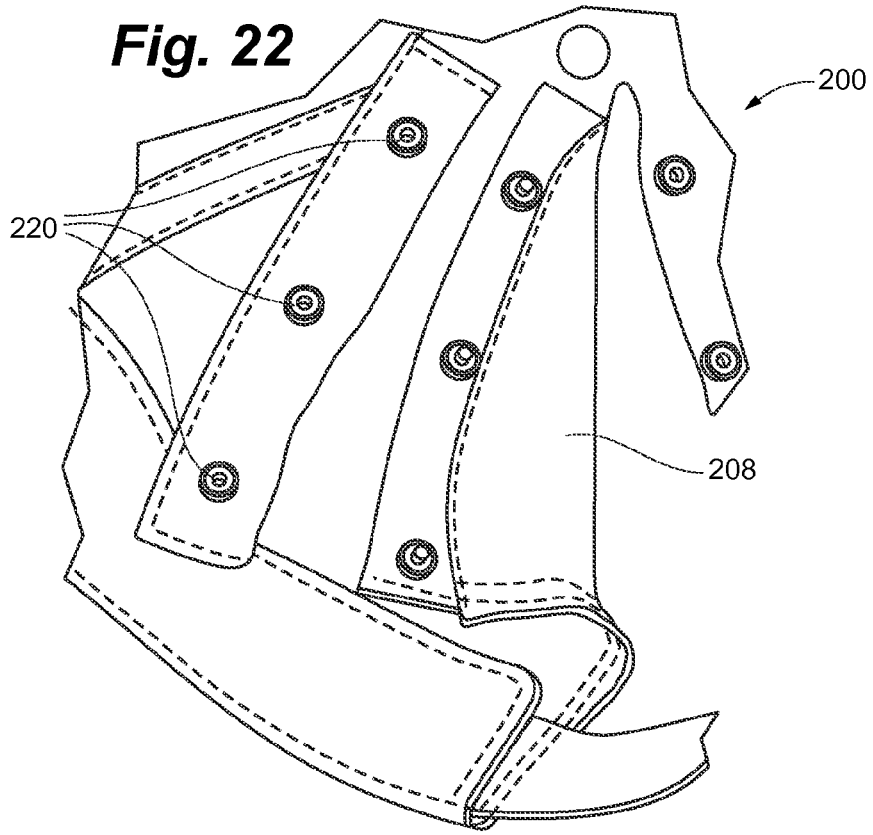
FIG. 22 is a partial interior view of the hat shown in FIGS. 18-21.

FIG. 22 is a partial interior view of the hat shown in FIGS. 18-21. The left half 208 of the hat, i.e., the left flap, is folded back inside the hat. On the interior of the hat is a set of fasteners 220 under a flap of material that can be exposed so that the fasteners on the left flap can be secured to the fasteners under the flap on the interior of the hat. By providing the fasteners on the interior of the hat on the flap, the fasteners do not irritate the user when wearing the cap in its closed configuration because the fasteners are not exposed to the wearer's head but are protected by the flap. A similar configuration is provided on the other side of the hat for the right half 210. The terms "left" and "right" are used with reference to viewing the cap from the rear exterior.

Figure 23:
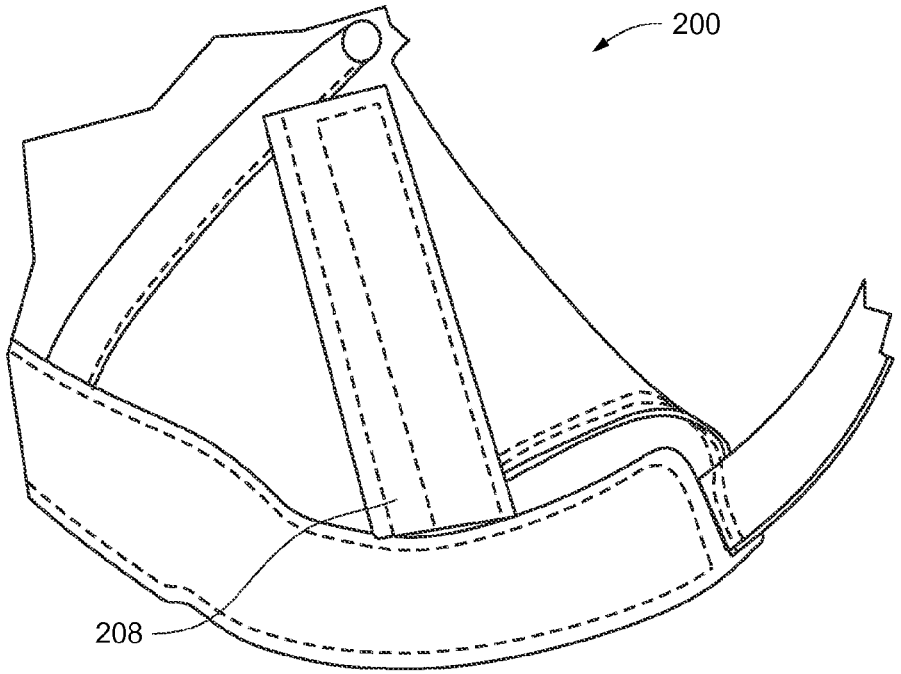
FIG. 23 is a partial interior view of the hat shown in FIG. 22 with a flap shown secured.

FIG. 23 is a partial interior view of the hat shown in FIG. 22 with a flap shown secured. As can be seen, once the left half 208 is secured in its open configuration, the fasteners are not exposed to the user's head thereby providing a comfortable fit without irritating the wearer's scalp.

Figure 24:
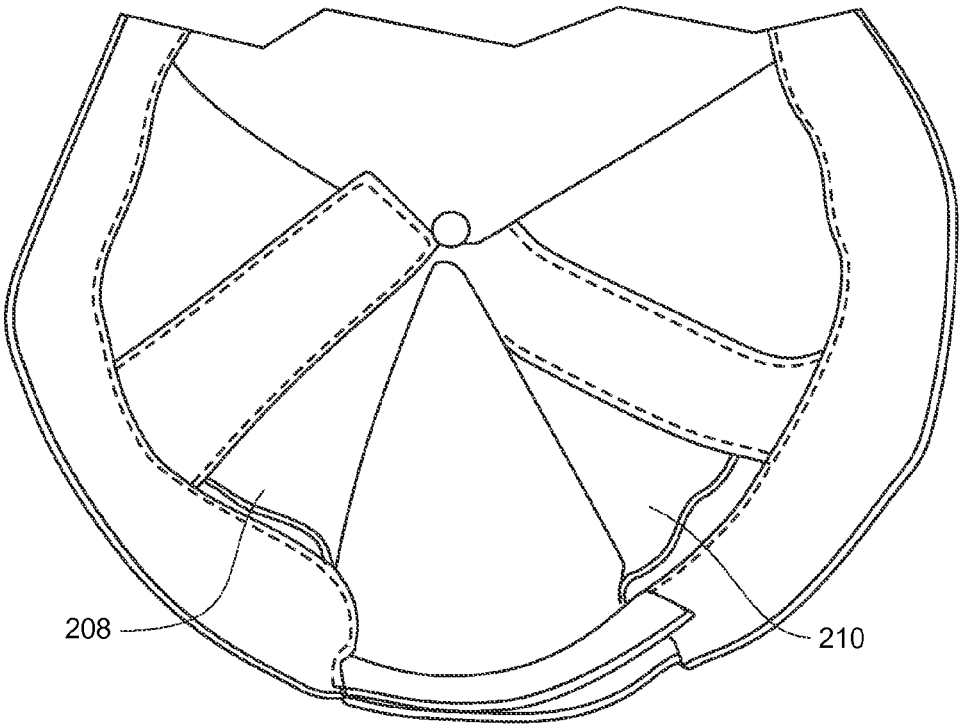
FIG. 24 is a partial interior view of the hat shown in FIGS. 22-23 with both flaps shown in a secured position.

FIG. 24 is a partial interior view of the hat shown in FIGS. 22-23 with both flaps shown in a secured position.

Figure 25:
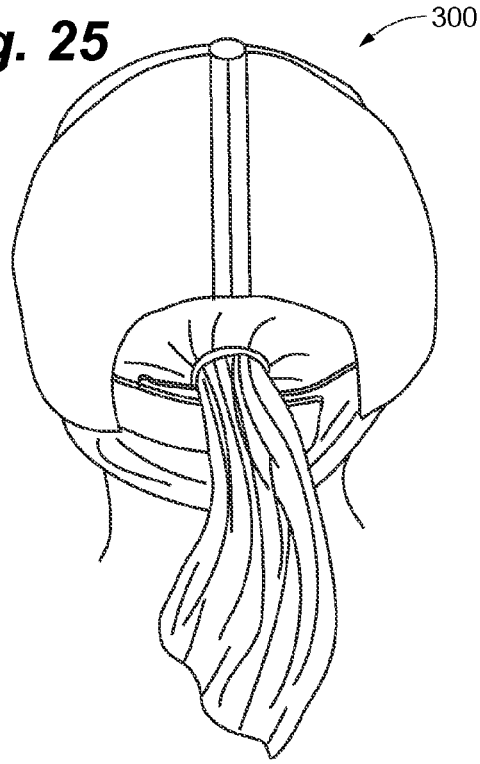
FIG. 25 is a rear perspective view of a configurable hat in a closed configuration according to another embodiment of the invention.

FIG. 25 is a rear perspective view of a configurable hat in a closed configuration according to another embodiment of the invention. This embodiment is similar to that shown in FIGS. 18-24 except that a different fastening system is used to secure the halves of the hat in its closed and open configurations. In particular, instead of snap-type fasteners, hook-and-loop-type fasteners are used such as those commercially available under the trademark Velcro.

Figure 26:
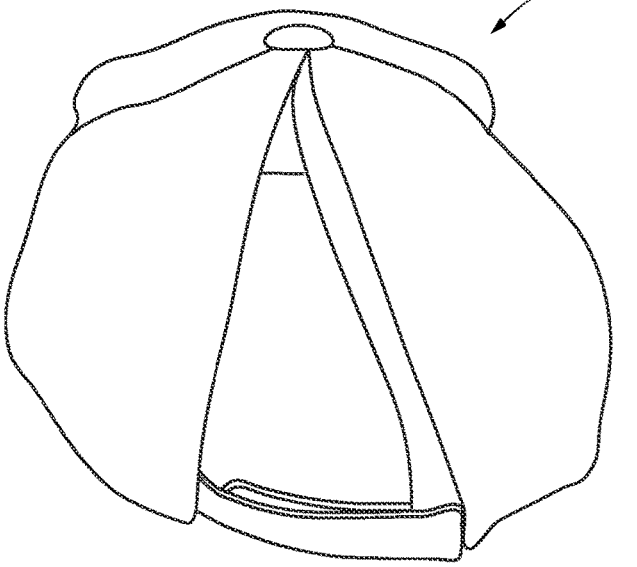
FIG. 26 is a rear perspective view of the configurable hat shown in FIG. 25 being transitioned from a closed configuration to an open configuration.

FIG. 26 is a rear perspective view of the configurable hat shown in FIG. 25 being transitioned from a closed configuration to an open configuration. Again, similar to the embodiment shown in FIGS. 18-24, the opening in the hat is provided by a left half and a right half that join along a central seam in the back of the hat.

Figure 27:
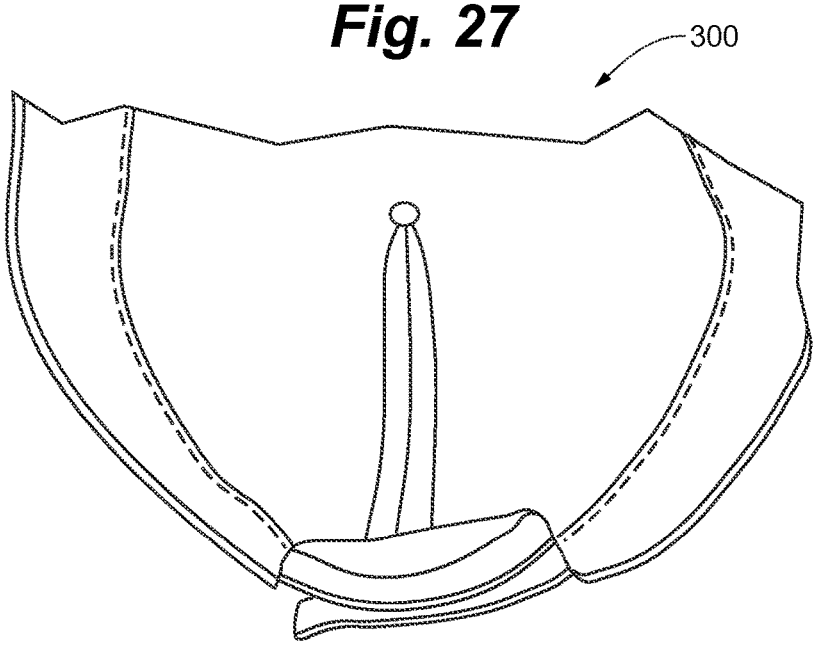
FIG. 27 is a partial interior view of the hat shown in FIGS. 25-26.

FIG. 27 is a partial interior view of the hat shown in FIGS. 25-26. The fastening system operates the same as s shown in FIGS. 18-24 except that the fasteners are hook-and-loop type fasteners.

Figure 28:
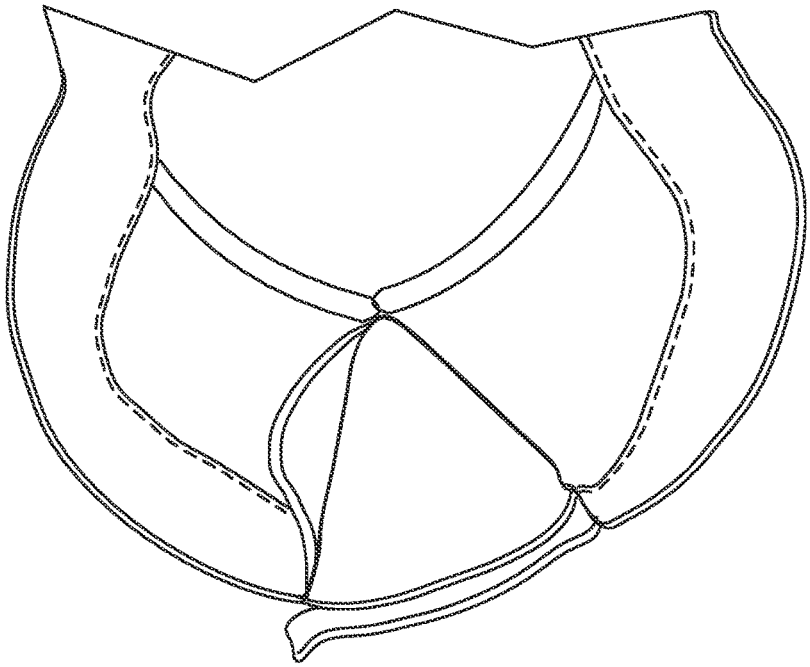
FIG. 28 is a partial interior view of the hat shown in FIG. 27.

FIG. 28 is a partial interior view of the hat shown in FIG. 27.

Figure 29:
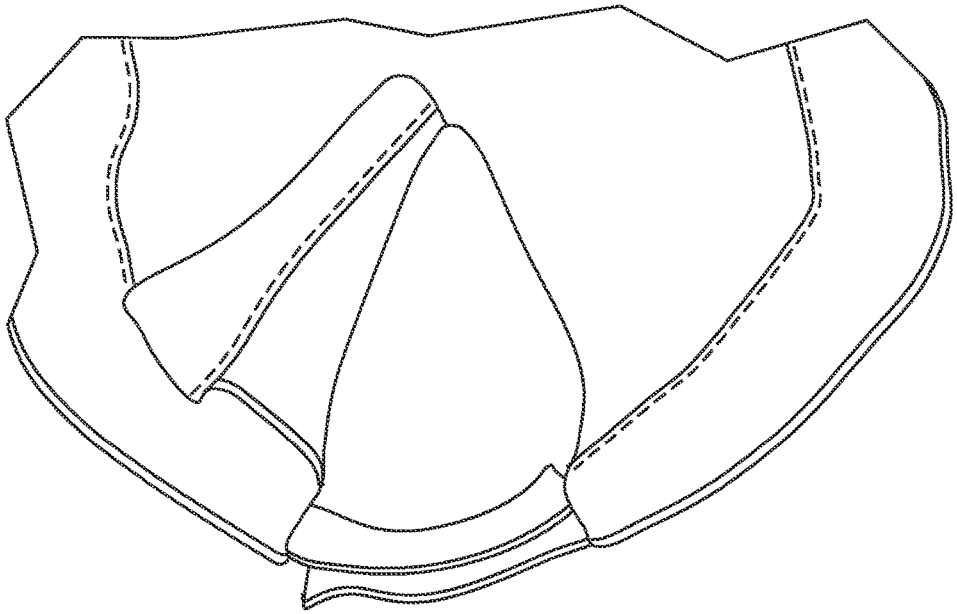
FIG. 29 is a partial interior view of the hat shown in FIGS. 25-28 with both flaps shown in a secured position.

FIG. 29 is a partial interior view of the hat shown in FIGS. 25-28 with both flaps shown in a secured position.

Figure 30:
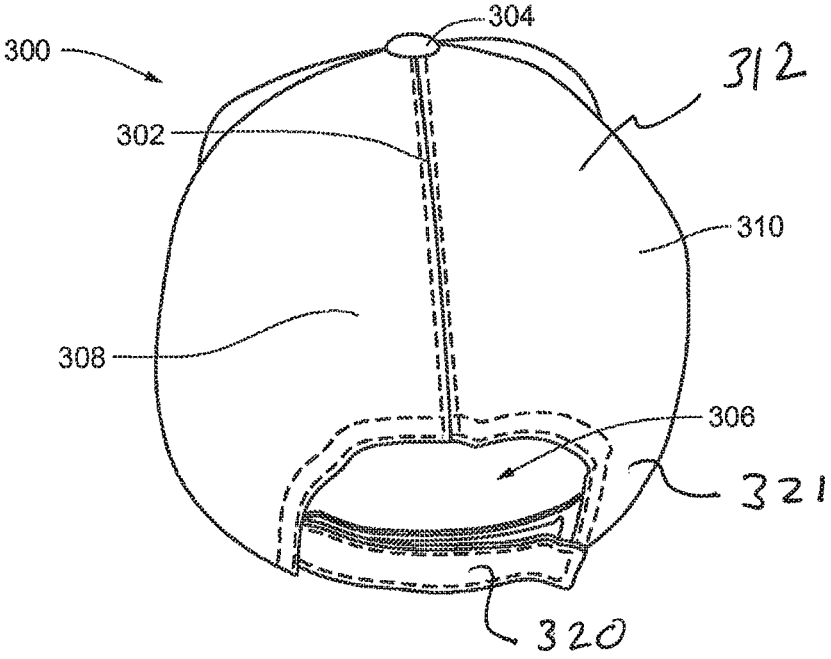
FIG. 30 is a rear perspective view of a configurable hat in a closed configuration according to another embodiment of the invention.

FIG. 30 is a rear perspective view of a configurable hat in a closed configuration according to another embodiment. In this particular embodiment, the hat 300 has a central seam 302 running from the top 304 of the hat 300 to an opening 306 in the back of the hat 300. The center seam 302 may alternatively start at about 1 inch below the top 304. The seam 302 joins a left half 308 and a right half 310 of the back of the hat together so as hat the hat is in a closed configuration much like the hats shown in FIGS. 18-019 and 26. FIG. 30 also shows a headband 320 located near a base 321 of a crown member 312, the headband 320 is similar to the headbands previously described with reference to the other embodiments.

Figure 31:
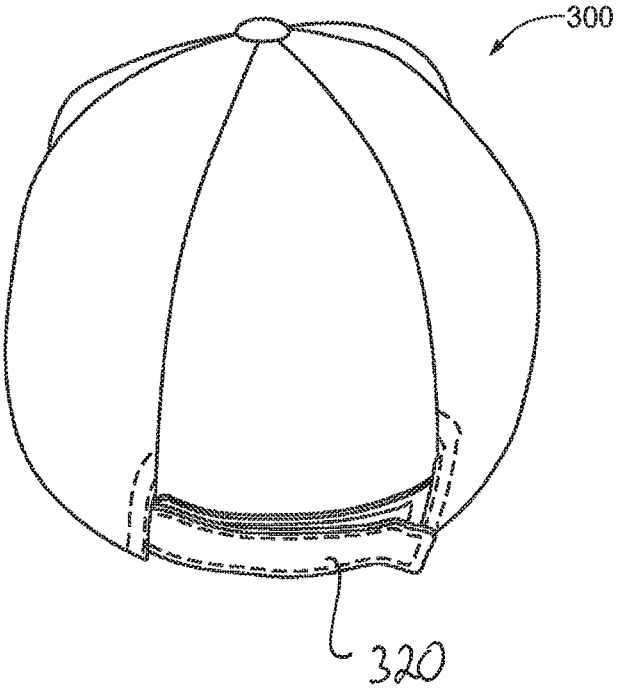
FIG. 31 is a rear perspective view of the configurable hat shown in FIG. 30 in an open configuration.

FIG. 31 is a rear perspective view of the configurable hat shown in FIG. 30 in an open configuration. As will be described in more detail; hereinafter, the left and right halves 308 and 310 are not joined together and have been folded back and secured inside the hat so that the hat is now in its open configuration to form a second opening in the crown member 12 exposing a second portion of a wearer's head which is inclusive of the first portion, the second opening being larger that the first opening, the second opening in the back of the hat to accommodate various hairstyles.

Figure 32:
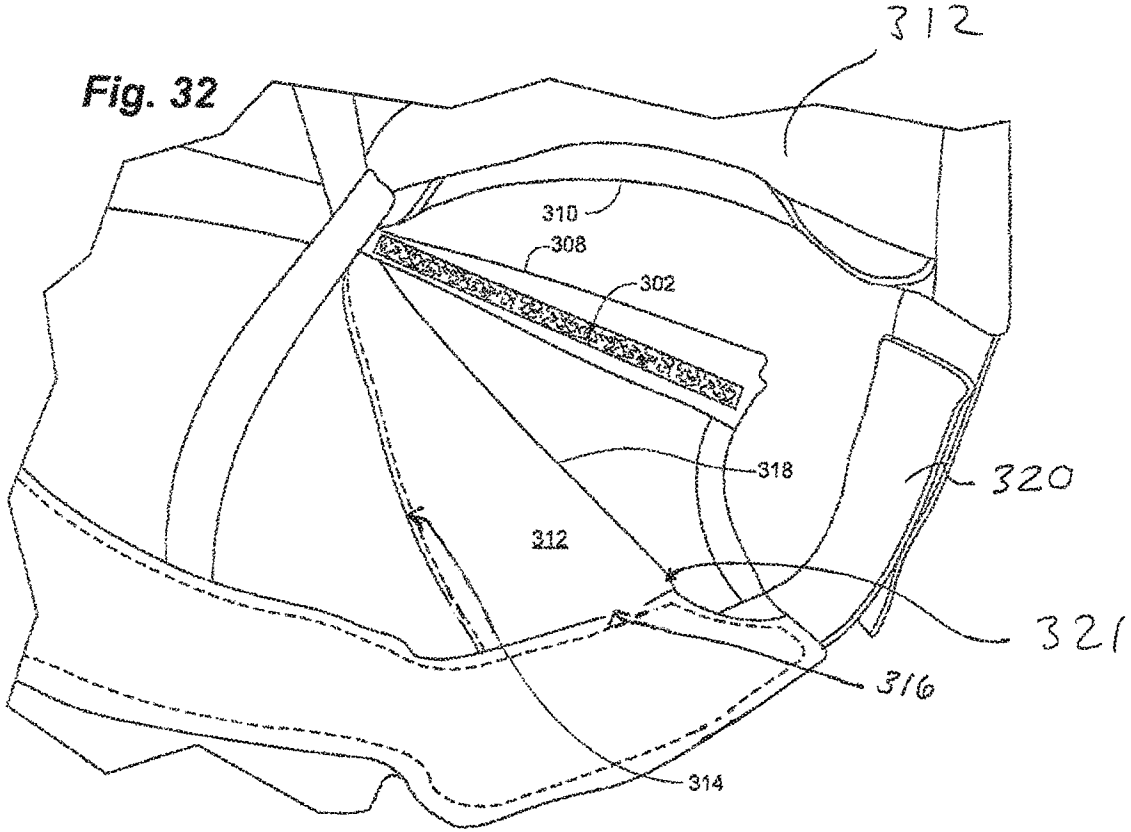
FIG. 32 is a partial interior view of the hat shown in FIGS. 30 and 31.

FIG. 32 is a partial interior view of the hat shown in FIGS. 30 and 31. The left half 308 of the hat has been unsecured from the right half 310 but the left half 308 has not yet been secured so that the hat is in its open configuration. In the illustrated embodiment, the left half 308 and the right half 310 of the hat are secured together along seam 302 by hook-and-loop type fasteners although other types of fasteners may be used such as snap-type fasteners. The securing means on each half 308, 310 may have a cover much like the flap on a zipper although such a cover is not necessary. Located on the interior of the cap is a pocket 312 to hold the left half 308 in place (a similar pocket is located near the right half 310 to hold it in place. The pocket 312 is formed by a triangular piece of fabric sewn to the interior of the hat along a first edge 314 and a second edge 316. The second edge 316 is the shortest in length and joins ends of the first edge 314 and a third edge 318. The third edge 318 forms an opening of the pocket.

Figure 33:
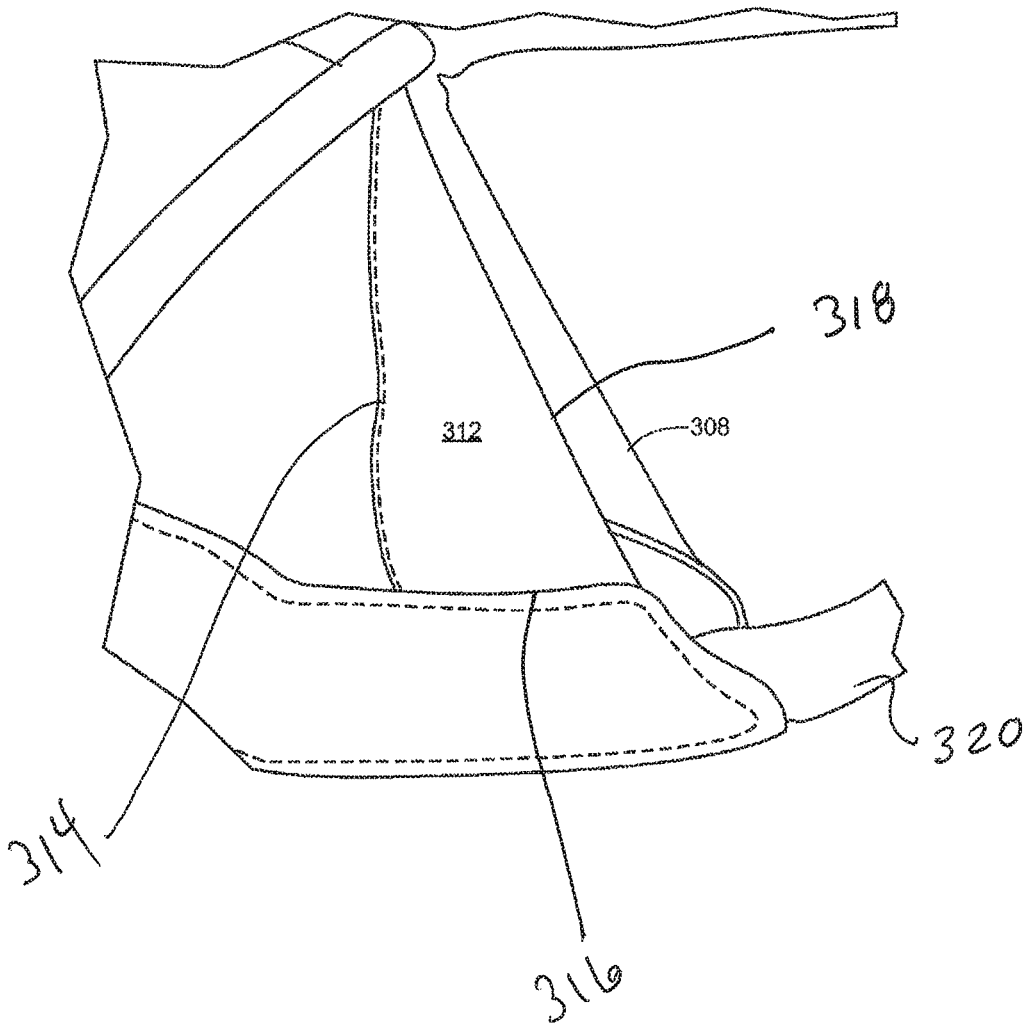
FIG. 33 is a partial interior view of the hat shown in FIGS. 30-32 with a left half shown secured in a pocket.

FIG. 33 is a partial interior view of the hat shown in FIGS. 30-32 with the left half 308 shown secured in the pocket 312. The left half 308 is simply tucked inside the pocket 312 which holds it in place without the need for additional securing devices inside the pocket.

Figure 34:
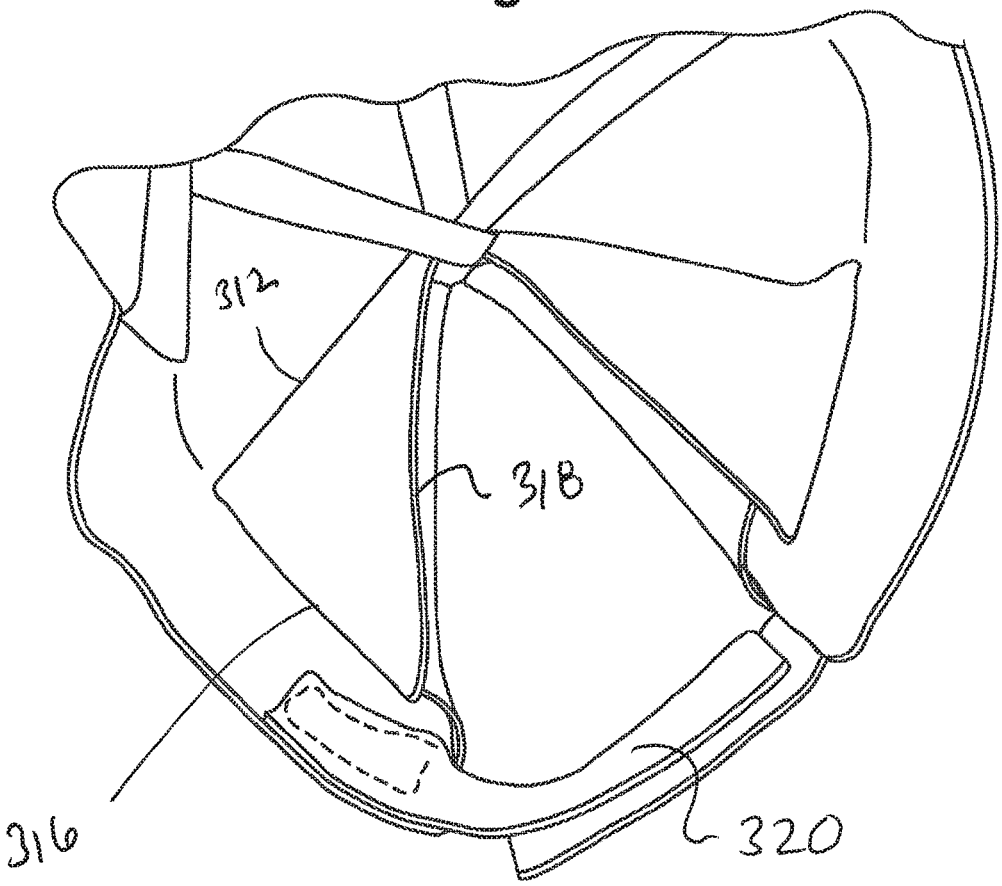
FIG. 34 is a partial interior view of the hat shown in FIGS. 30-31 with both halves shown secured in respective pockets.

FIG. 34 is a partial interior view of the hat shown in FIGS. 30-31 with both halves shown secured in their respective pockets.

Figure 35:
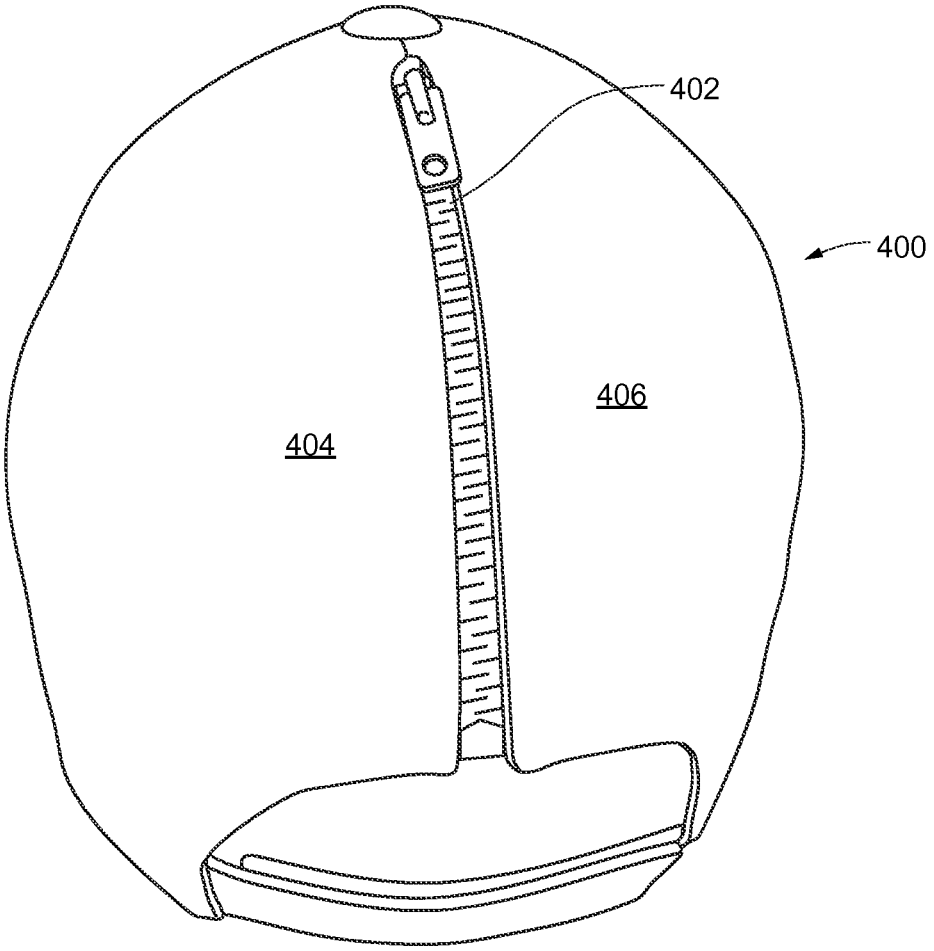
FIG. 35 is a rear perspective view of a configurable hat according to another embodiment of the invention.
Figure 36:
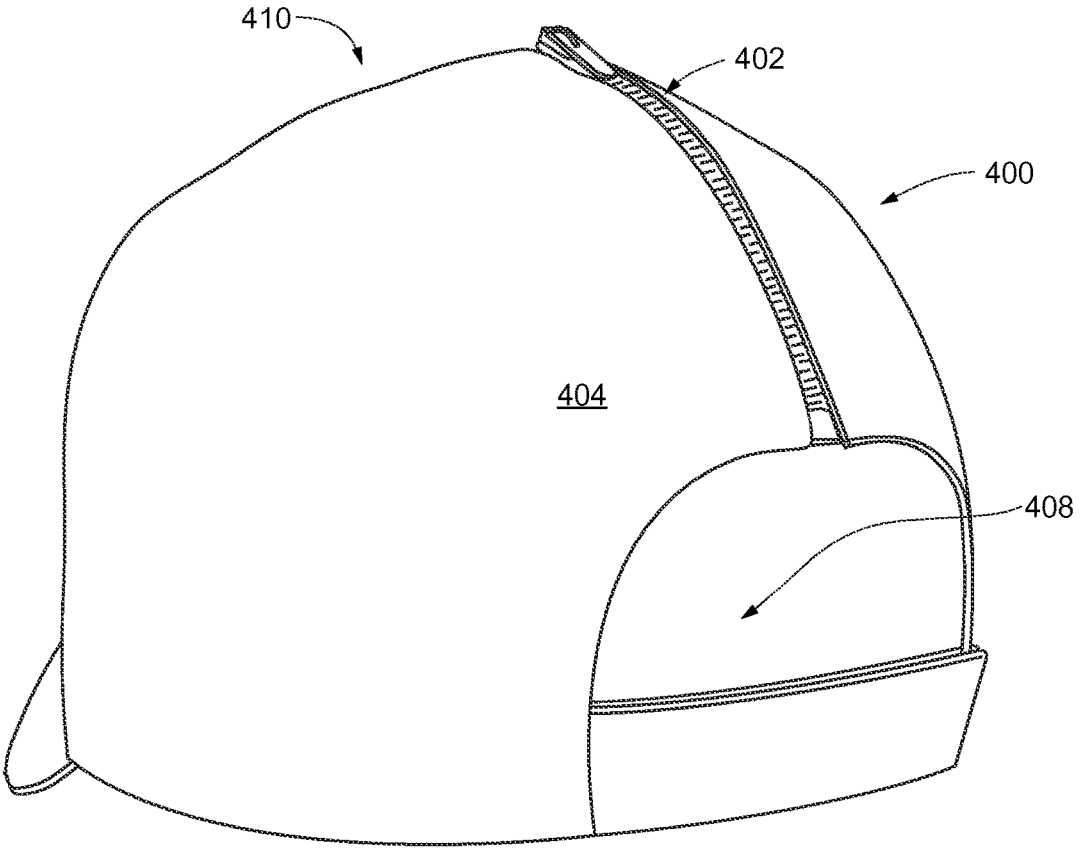
FIG. 36 is a side perspective view of the hat shown in FIG. 35.

FIG. 35 is a rear perspective view of a configurable hat according to another embodiment of the invention. FIG. 36 is a side perspective view of the hat shown in FIG. 35. The hat 400 shown in FIGS. 35 and 36 uses a zipper 402 to join the left and right halves 404, 406 respectively together. The zipper 402 can run in either direction, from near the opening 408 in the hat 400 to its crown 410 or in the opposite sense. The zipper may start at the top of the crown 410 or it may start about 1 inch below the top of the crown 410. The zipper 402 is completely separable so that the flaps 404, 406 completely detach form one another. Similar securing systems as described above, for storing the halves 404, 406 when the hat is in the open configuration may be used.

Thus, embodiments of the invention are disclosed. Although the present invention has been described in considerable detail with reference to certain disclosed embodiments, the disclosed embodiments are presented for purposes of illustration and not limitation and other embodiments of the invention are possible. One skilled in the art will appreciate that various changes, adaptations, and modifications may be made without departing from the spirit of the invention and the scope of the appended claims.

What is claimed is:

1. A hat comprising:

a headband shaped to fit about a portion of a wearer's head when the hat is worn by a wearer;

a crown member attached to the headband, the crown member configured to cover a portion of the wearer's head when the hat is being worn, wherein the crown member has a top configured to be located over a top portion of the wearer's head and a front portion extending from the top in a forward direction, the crown member also has a back portion extending from the top in a backward direction, the crown member comprising:

an interior surface that faces the wearer's head when the hat is worn;

an exterior surface opposite to the interior surface of the crown member which faces away from the wearer's head when the hat is worn; and a first and a second pocket located on the interior surface of the crown member wherein each of the first and second pocket are formed by a triangular piece of fabric, the triangular piece of fabric has a first edge, a second edge and a third edge wherein the second edge is shortest in length and joins an end of the first edge and third edge of the triangular piece of fabric, wherein the third edge forms an opening into which a left half and a right half of the back portion of the crown member are capable of being folded into respectively, wherein the back portion of the crown member is configured to move in two configurations:

a closed configuration wherein the left half is joined to the right half along a seam defined by an edge of each half to form a first opening in the crown member;

and an open configuration wherein the left half is not joined to the right half and the left half and the right half are each folded into their respective pocket to form a second opening in the crown member which includes the first opening.

2. The hat according to claim 1 wherein the headband is adjustable to accommodate different head sizes.

3. The hat according to claim 1 wherein the headband is adjustable using hook-and-loop fastener.

4. The hat according to claim 1 further comprising a bill attached to the headband and extending angularly forward from the headband and the front portion of the crown member.

5. The hat according to claim 1 wherein the left and right halves of the crown member are joined together by a hook-and-loop fasteners.

6. The hat according to claim 1 wherein the left and right halves of the crown member are joined together by a zipper.

7. The hat according to claim 1 wherein the left and right halves of the crown member are joined together by snap joints.

* * * * *